US008157474B2

(12) United States Patent
Mahler et al.

(10) Patent No.: US 8,157,474 B2
(45) Date of Patent: Apr. 17, 2012

(54) ROAD FINISHING MACHINE

(75) Inventors: Anton Mahler, Wennigsen (DE); Marc Niggemann, Hameln (DE); Oliver Lachmann, Hameln (DE)

(73) Assignee: ABG Allgemeine Baumaschinen-Gesellschaft mbH, Hameln (DE)

( * ) Notice: Subject to any disclaimer, the term of this patent is extended or adjusted under 35 U.S.C. 154(b) by 0 days.

(21) Appl. No.: 12/867,676

(22) PCT Filed: Apr. 30, 2009

(86) PCT No.: PCT/EP2009/003134

§ 371 (c)(1),
(2), (4) Date: Aug. 13, 2010

(87) PCT Pub. No.: WO2009/141048

PCT Pub. Date: Nov. 26, 2009

(65) Prior Publication Data

US 2010/0310312 A1 Dec. 9, 2010

(30) Foreign Application Priority Data

May 17, 2008 (DE) ..... 10 2008 024 083

(51) Int. Cl.
*E01C 23/14* (2006.01)

(52) U.S. Cl. ..... 404/95; 404/118

(58) Field of Classification Search ..... 404/95, 404/118; 219/672

See application file for complete search history.

(56) References Cited

U.S. PATENT DOCUMENTS

| | | | | | |
|---|---|---|---|---|---|
| 2,493,542 | A * | 1/1950 | McGraw | 338/319 |
| 5,359,179 | A * | 10/1994 | Desloge et al. | 219/535 |
| 5,397,199 | A * | 3/1995 | Frampton et al. | 404/118 |
| 5,417,516 | A * | 5/1995 | Birtchet | 404/71 |
| 5,899,630 | A * | 5/1999 | Brock | 404/79 |
| 6,318,928 | B1 * | 11/2001 | Swearingen | 404/72 |
| 6,963,050 | B2 * | 11/2005 | Heindtel | 219/213 |
| 6,981,820 | B2 * | 1/2006 | Nelson | 404/118 |

FOREIGN PATENT DOCUMENTS

| | | |
|---|---|---|
| DE | 8413555 U1 | 4/1986 |
| DE | 20219641 U1 | 2/2003 |
| EP | 1757734 A1 | 2/2007 |
| WO | WO01/51713 A | 7/2001 |
| WO | WO03/000995 A | 1/2003 |

* cited by examiner

*Primary Examiner* — Gary S Hartmann

(74) *Attorney, Agent, or Firm* — Kilpatrick Townsend & Stockton LLP

(57) ABSTRACT

The invention relates to a road finishing machine having a screed extending transverse to the working direction of the finishing machine. The machine includes a base plate that can be heated using an electrical heater clamped to the base plate. The heater has at least one bar-shaped heating element, wherein the bar-shaped heating element includes a round tube heating element having at least one heating bar fixably supported on individual bolts that can be attached to the base plate and forming heat transfer bridges.

15 Claims, 9 Drawing Sheets

Figure 1:
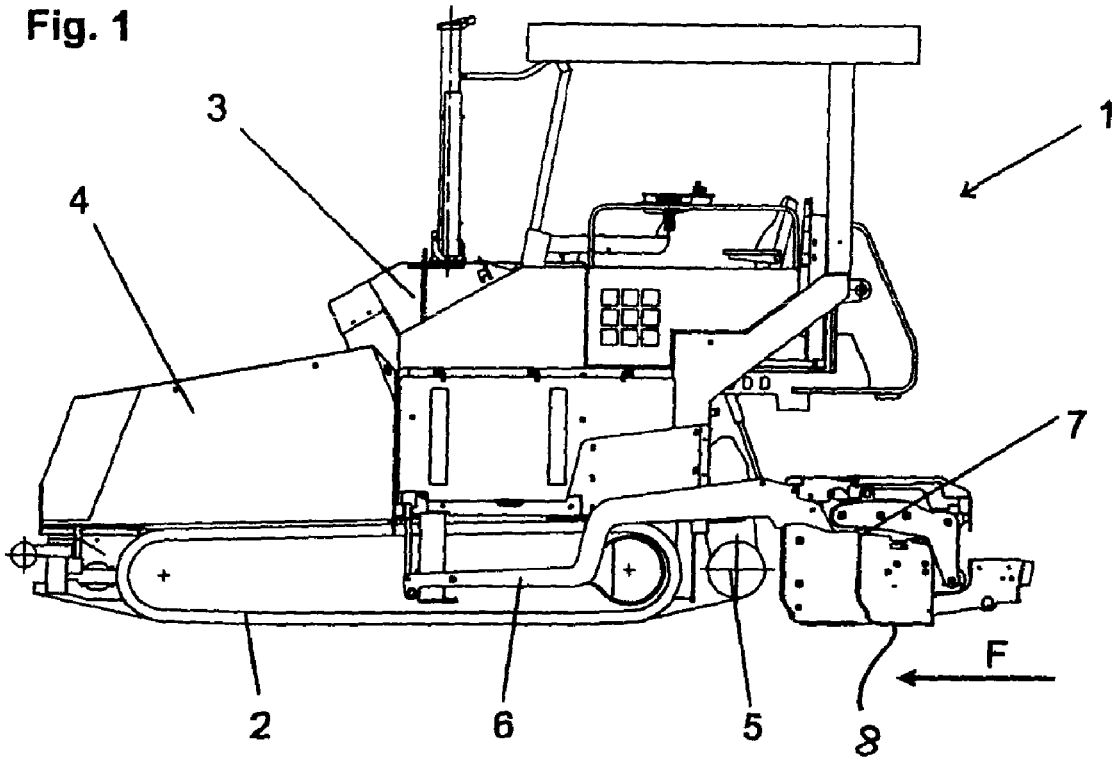

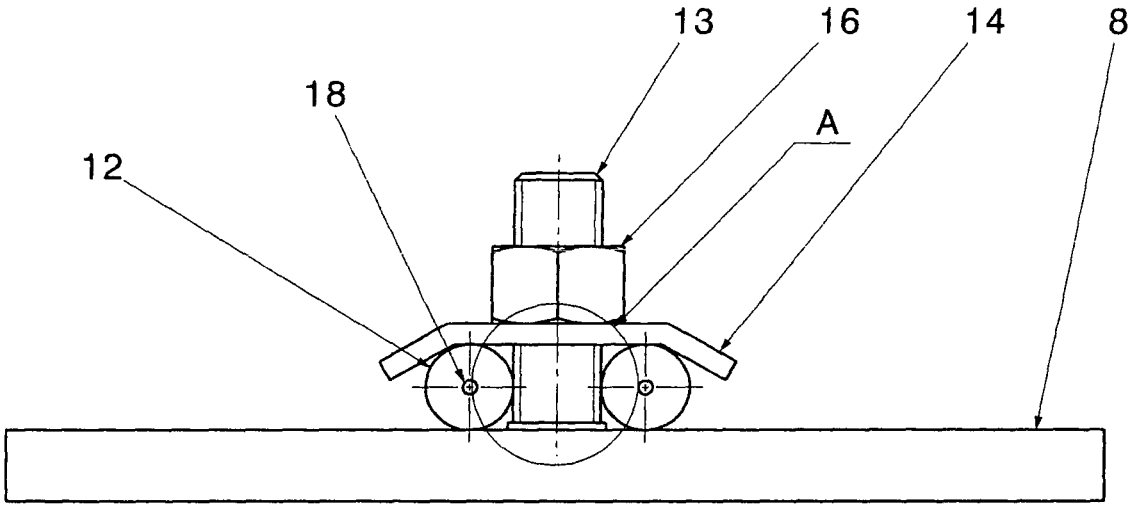
Fig. 4
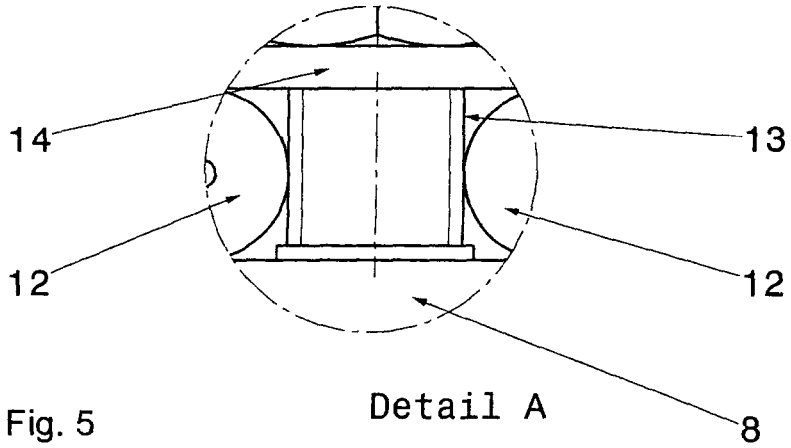
Fig. 5 Detail A

Fig. 8
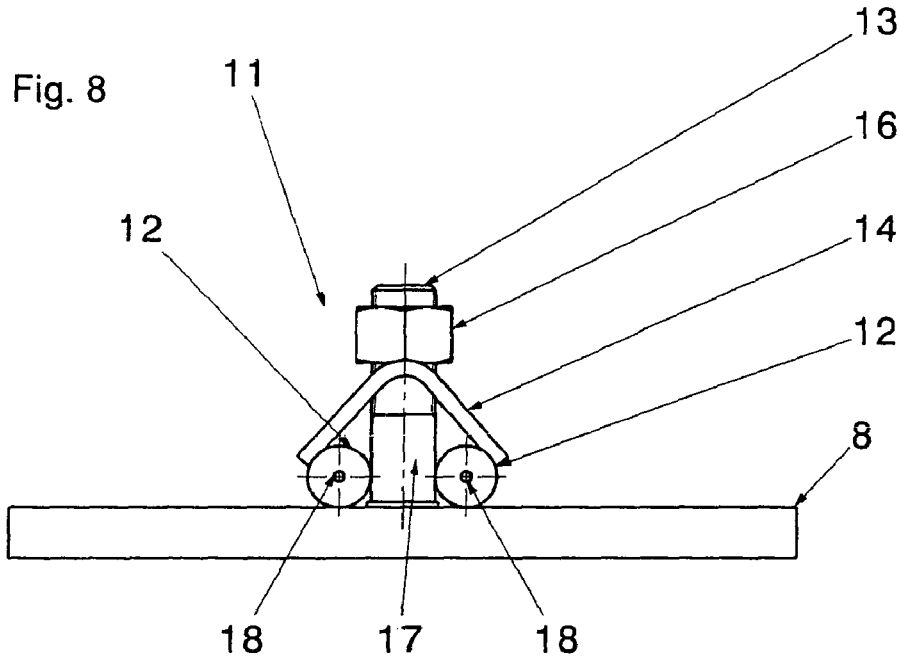
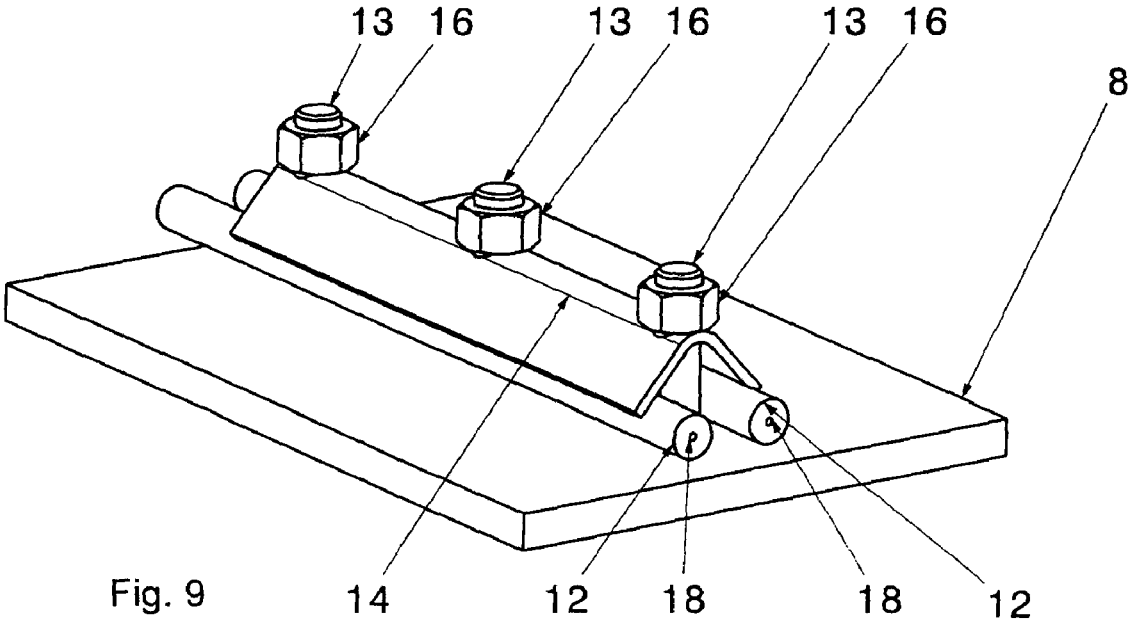
Fig. 9

Fig. 12
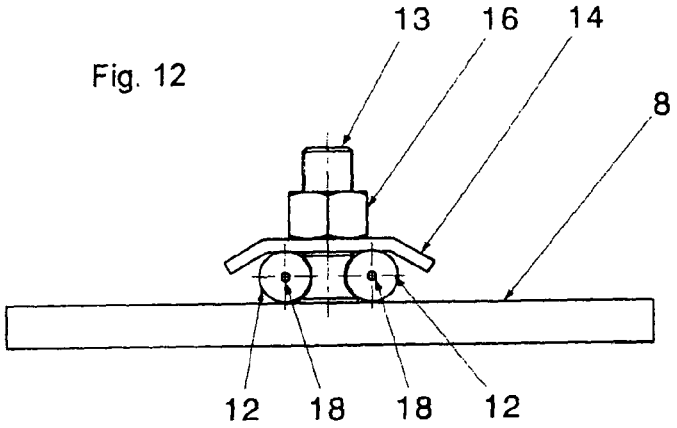
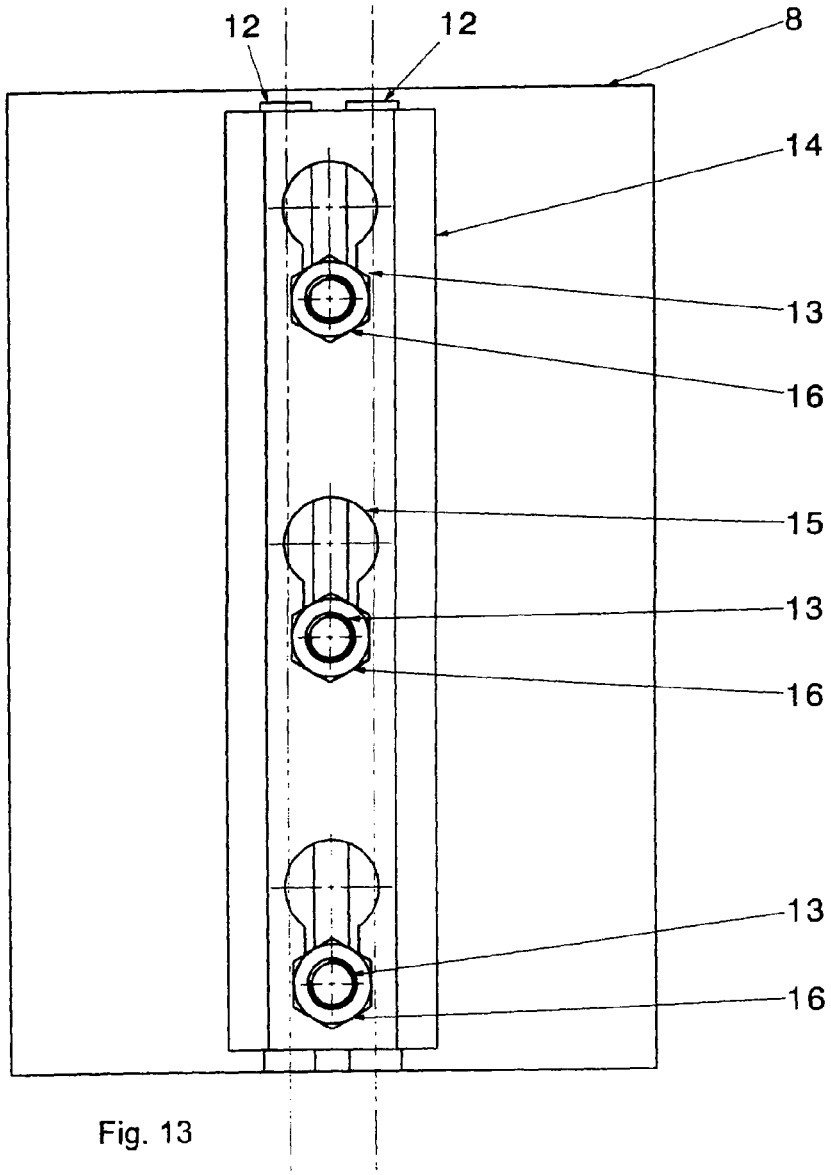
Fig. 13

ROAD FINISHING MACHINE

The invention relates to a road finisher according to the preamble of claim 1.

The screed fastened to a road finisher has the task of uniformly compacting the paving material over the entire paving width and of producing a closed, planar structure. To prevent the bituminous paving material in the warm state from remaining stuck to the base plate of the screed, the screed has a heater. Conventionally, the screed is heated with a gas or electric heater. As a result, the material can be optimally laid and compacted.

As known from DE 203 05 577 U1, the electrical variant is usually implemented by means of electrical heating bars of which a plurality are arranged distributed on the base plate of the screed. The heating bars are connected to a power source. The amount of heat required for heating the base plate is in this case introduced into the base plate via heat transfer through contact. A disadvantage is that the heat distribution of the heat input is not sufficiently uniform, thereby having a disadvantageous effect on the heating-up time which determines the readiness of use of the road finishers. Furthermore, the heating bars used have a tendency to break. The replacement of defective heating bars leads to undesired downtimes of the road finisher, with the result that the maintenance requirement is increased.

The object of the invention is therefore to provide a road finisher according to the preamble of claim 1 whose screed heater improves a heat distribution of the base plate, is low-maintenance and has a good heating capacity.

This object is achieved according to the invention by the features of claim 1.

As a result, a road finisher is provided whose screed has an improved electrical heating element. The round-tube heating body is particularly robust. The fastening of the round-tube heating body on the base plate by the clamping according to the invention surprisingly provides a more uniform heating pattern of the base plate. This is achieved in particular in that the fastening bolts are incorporated directly for heat transfer.

For this purpose, the round-tube heating body can preferably be positioned on the base plate in a loop to the right and left of the fastening bolts. The heat exchange then takes place from the heating bar to the base plate and from the heating bar via the thermal links to the base plate. Different circumferential regions of the heating bar are used as contact surface for transporting heat to the base plate.

Furthermore, it is advantageous that the heat energy can be introduced over a relatively large area as a function of the thickness of the bolts. This promotes the more uniform heating of the base plate.

To fix the heating element, a clamping plate is preferably provided. Such a clamping plate makes it possible to reduce the radiant emission of the heat.

Further refinements of the invention can be found in the following description and in the subclaims.

The invention will be explained in more detail below with reference to the exemplary embodiments illustrated in the appended drawings.

Figure 3:
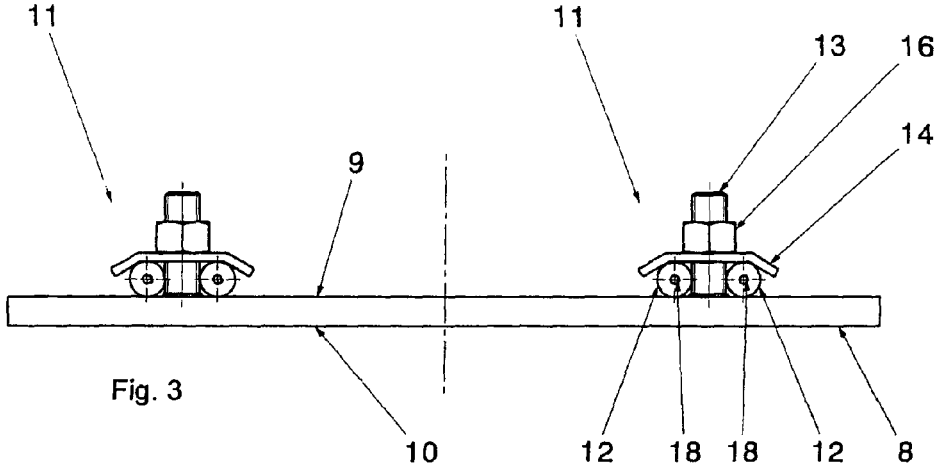
Figure 2:
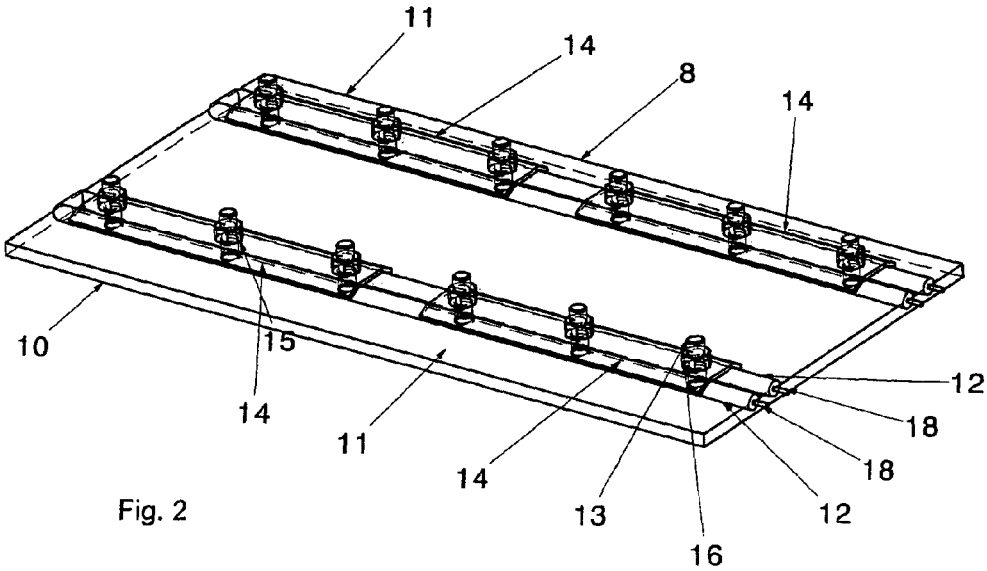
Figure 6:
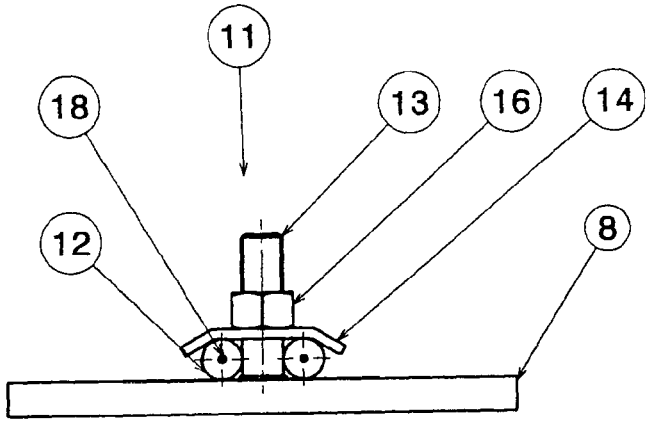
Figure 7:
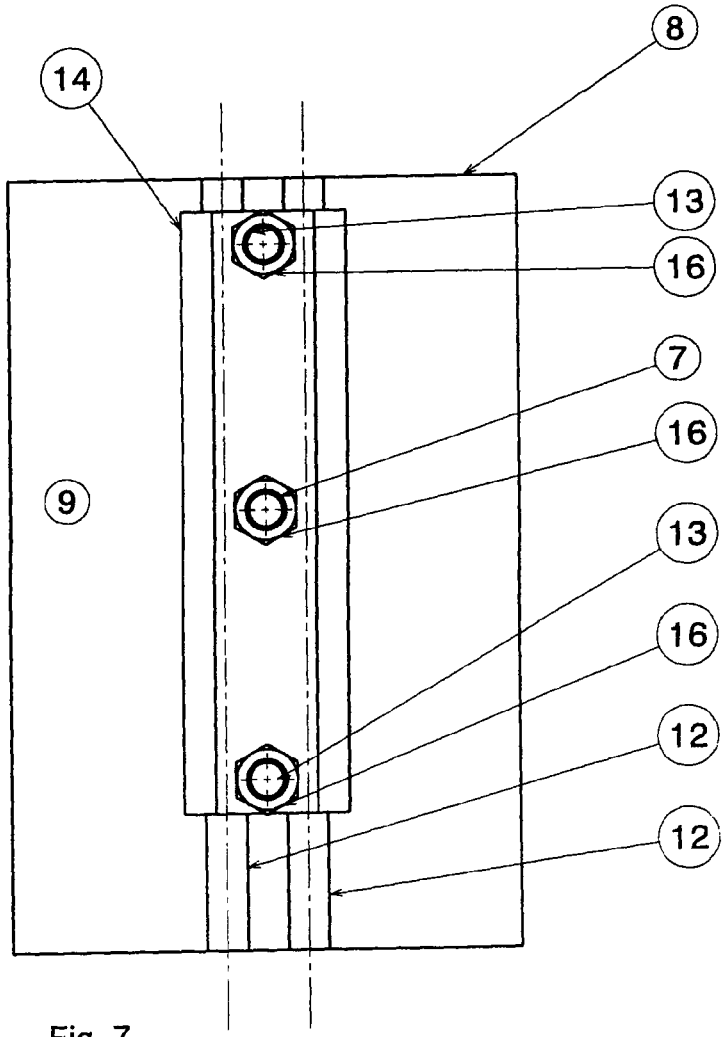
Figure 10:
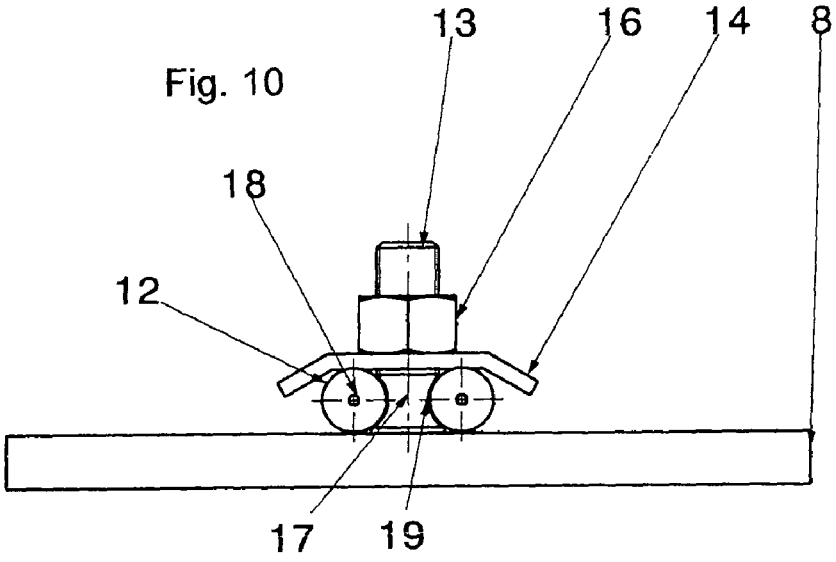
Figure 11:
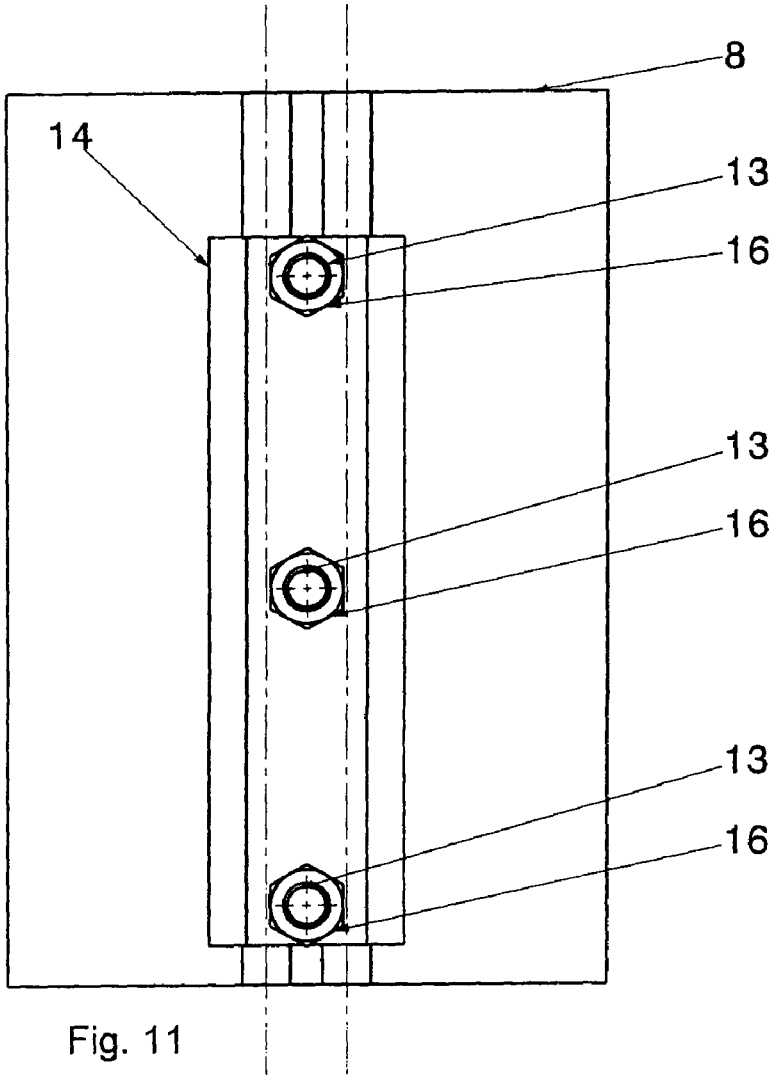
Figure 14:
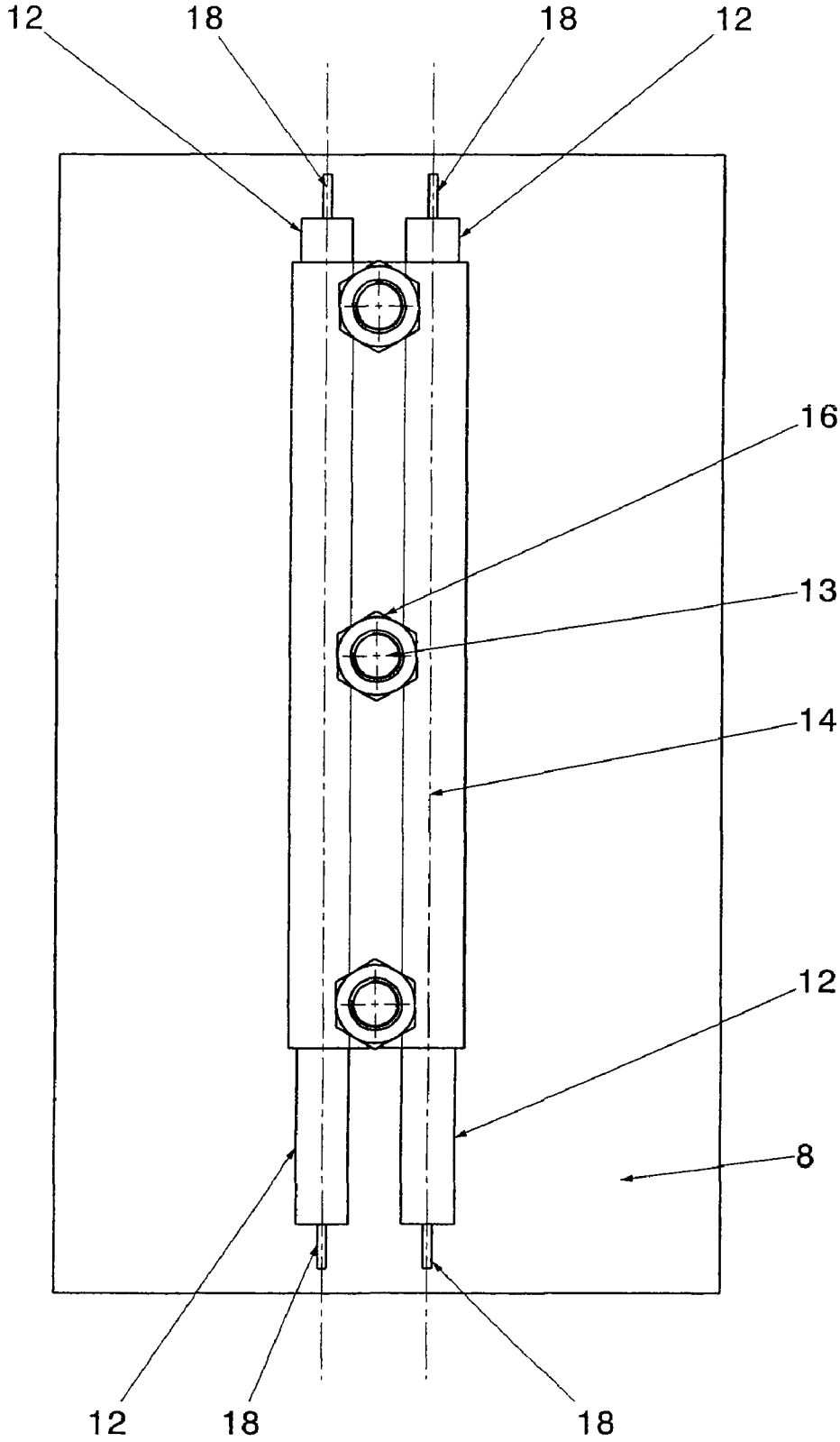
Figure 15:
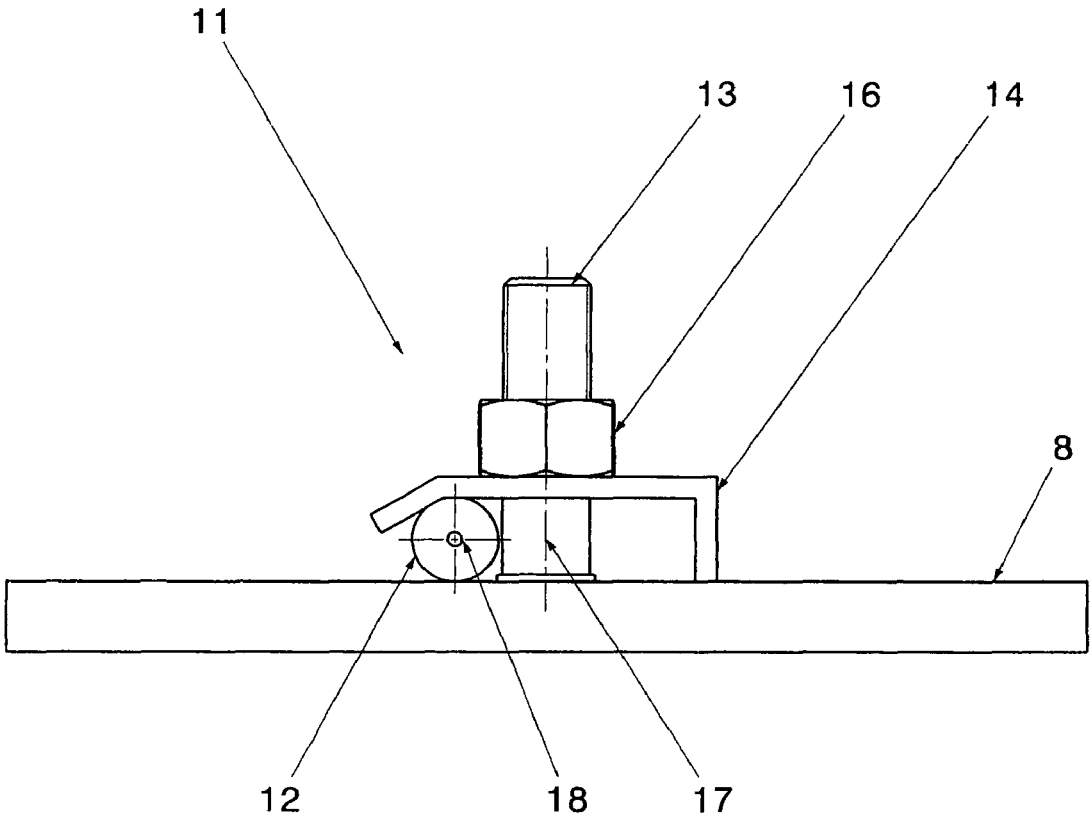

FIG. 1 shows a schematic side view of a road finisher,

FIG. 2 schematically shows an upper view of a base plate with a heating element according to a first exemplary embodiment, FIG. 3 shows a front view of the base plate according to FIG. 2, FIG. 4 shows a heating element according to FIG. 3 in an enlarged representation, FIG. 5 shows the detail A according to FIG. 4 in a still further enlarged view, FIG. 6 shows a front view of a base plate with a heating element according to a second exemplary embodiment, FIG. 7 shows a partial plan view of the base plate according to FIG. 6, FIG. 8 shows a front view of a base plate with a heating element according to a third exemplary embodiment, FIG. 9 shows a partial upper view of the base plate according to FIG. 8, FIG. 10 shows a front view of a base plate with a heating element according to a fourth exemplary embodiment, FIG. 11 shows a partial plan view of the base plate according to FIG. 10, FIG. 12 shows a front view of a base plate with a heating element according to a fifth exemplary embodiment, FIG. 13 shows a partial plan view of the base plate according to FIG. 12, FIG. 14 shows a partial plan view of a base plate with a heating element according to a sixth exemplary embodiment, FIG. 15 shows a front view of a base plate with a heating element according to a seventh exemplary embodiment.

FIG. 1 shows a road finisher 1 with a chassis 2, a drive unit 3, a material bunker 4 situated to the front in the direction of travel F, and a distribution auger 5 situated behind. Lateral arms 6 are used to tow a screed 7 which lays paving material which is transported rearwardly from the material bunker 4 and distributed by the distribution auger 5. The screed 7 is preferably a vibration screed which smoothes and compacts. For this purpose, the screed 7 has a heatable base plate 8. The heater is situated inside the screed 7 and is mounted on the upper side 9 of the base plate 8 situated inside the screed 7. An underside 10 of the base plate 8 forms the external smoothing plate of the screed 7. The screed 7 can be designed as a double screed with two screeds 7 which are arranged behind one another in the direction of travel F and which each have a base plate 8.

The road finisher 1 shown in FIG. 1 having the screed 7 extending transversely to the working direction of the finisher 1 has a heatable base plate 8 onto which an electrical heater is clamped.

FIG. 2 to FIG. 5 show a first exemplary embodiment of this electrical heater. Accordingly, the electrical heater comprises at least one bar-shaped heating element 11 which has a round-tube heating body which, as a heating filament, is folded over at least once so as to form two heating bars 12 which are arranged adjacently and at a spacing from one another such that adjacent heating bars 12 are fixably supported on individual bolts 13, the so-called fastening bolts, which can be fastened to the base plate 8. The bolts 13 are positioned in the spacing region of the two heating bars 12 and can be fastened to the base plate 8. Preferably, a number of individual bolts 13 are arranged at a distance from one another in a row within the loop which the heating element 11 forms by the two heating bars 12. The bolts 13 each form a heat-conducting link from the adjacent heating bars 12 to the base plate 8.

The two adjacent heating bars 12 of a heating element 11 contact the bolts 13 in that they are supported on the bolts 13. This contact results in a heat transfer from the heating bars 12 to the bolts 13. The bolts 13 have a good thermal conductivity since they are preferably made of metal and therefore transfer heat to the base plate 8, with which the bolts 13 are also in contact through their fastening. The heat energy can be introduced over a relatively large area as a function of the thickness of the bolts 13, although the round-tube heating bodies of the heating bars 12 have, by contrast with flat-tube heating bodies, a reduced bearing surface on the base plate 8 via which the heat conduction takes place.

In order to clamp the heating element 11 onto the base plate 8, at least one clamping plate 14 is preferably provided which is seated in a roof-shaped manner on the heating filament folded over at least once. The clamping plate 14 thus covers, at least along a part of the length or width (depending on the orientation of the heating elements 11 with respect to the dimensions of the base plate 8) of the base plate 8, the heat transfer system consisting of two adjacent heating bars 12 with integrated bolt 13. According to FIG. 2, two clamping plates 14 at a distance from one another are provided for one heating element 11. The clamping plate 14 preferably has cutouts 15 for plugging through a respective bolt 13. By means of lock nuts 16 which can be screwed onto the bolts 13, the clamping plate 14 can be clamped against the base plate 8, with the result that the respectively adjacent two heating bars 12 are frictionally clamped between the base plate 8 and clamping plate 14.

The two heating bars 12 have, offset in the circumferential direction with respect to the heat-conducting links of the bolts 13, a respective heat exchange surface with respect to the base plate 8, for which purpose the heating bars 12 contact the base plate 8. The heating bars 12 preferably lie directly on the base plate 8.

In the contact region with the heating bars 12, the bolts 13 can be designed with a smooth shaft 17 or as screw bolts with a screw shaft. The second exemplary embodiment represented in FIG. 6 and FIG. 7 differs from the first exemplary embodiment only in that the bolts 13 are designed with a smooth shaft 17, whereas in the first exemplary embodiment a screw shaft is provided.

The number of heating elements 11 which are clamped onto the upper side 9 of the base plate 8 is selectable. Preferably, at least two heating elements 11 arranged with a spacing from one another are provided which each ensure a wide-area heat transfer by means of a heat transfer system consisting of two adjacent heating bars 12 with integrated bolts 13.

According to the third exemplary embodiment of the invention represented in FIG. 8 and FIG. 9, the clamping plate 14 is not, as represented for example in FIG. 4, designed in the form of a flat roof but in the form of a pointed roof. The radiant emission of the heat can be optimized by the roof shape of the clamping plate 14.

According to the fourth exemplary embodiment represented in FIG. 10 and FIG. 11, the bolts 13 each have, in the region of their shaft 17 on which the heating bars 12 are supported, a circumferential cutout 19 adapted to the outer circumference of the heating bars 12.

To simplify the mounting and removal of the clamping plate 14, as represented in the fifth exemplary embodiment of FIG. 12 and FIG. 13, the clamping plate 14 can have keyhole-like cutouts 15 for removably and lockably receiving the bolts 13 with lock nuts 16.

In all of the above-described exemplary embodiments, the round-tube heating body preferably comprises a metal tube in which a heating conductor 18 guided in an insulating material is arranged. The heating element 11 can be connected to a power supply in a known manner via a respective connecting block.

According to a sixth exemplary embodiment represented in FIG. 14, the bar-shaped heating element has at least two heating bars 12 which are separated from one another. These are individual heating bars 12 whose heating conductors 18 can be connected to opposite sides of the base plate 8 via connecting blocks. Moreover, the above statements apply correspondingly.

Finally, FIG. 15 shows a seventh exemplary embodiment of the electrical heater according to the invention for the base plate 8. The bar-shaped heating element 11 has a round-tube heating body which has at least one heating bar 12 which is fixedly supported on bolts 13 which can be fastened to the base plate 8 and which form heat-conducting links. The clamping plate 14 is then preferably supported on the base plate 8, for which purpose the clamping plate 14 can have a support leg on one side. The shielding of the at least one heating bar 12 is thus improved in order likewise to use the heat radiation for heating the base plate 8. This applies in particular when the shaft 17 of the bolt 13 forms only a one-sided thermal link to a heating bar 12, as represented in FIG. 15.

The invention claimed is:

1. A road finisher having a screed extending transversely to the working direction of the finisher, said screed having a base plate which is heatable by an electrical heater clamped to the base plate, said heater comprising at least one bar-shaped heating element comprising a round-tube heating body which is fixably supported on individual bolts which can be fastened to the base plate and which form heat-conducting bridges, wherein the round-tube heating body is positioned on a base plate in a loop to the right and left of the bolts, in such a manner that different circumferential regions of the heating bar are used as contact surface for transporting heat to the base plate.

2. The road finisher as claimed in claim 1, characterized in that the round-tube heating body has at least two heating bars which are arranged adjacently and at a spacing from one another such that adjacent heating bars are fixedly supported on the individual bolts which can be fastened to the base plate, which bolts are positioned in the spacing region of the two heating bars and each form a heat-conducting link between the adjacent heating bars and the base plate.

3. The road finisher as claimed in claim 2, characterized in that the round-tube heating body forms a heating filament which is folded over at least once so as to form two adjacently arranged heating bars.

4. The road finisher as claimed in claim 1, characterized in that a number of individual bolts are arranged at a distance from one another along the bar-shaped heating element.

5. The road finisher as claimed in claim 1, characterized in that the at least one heating bar has, offset in the circumferential direction with respect to the heat-conducting links, a heat exchange surface with respect to the base plate.

6. The road finisher as claimed in claim 5, characterized in that the at least one heating bar contacts the base plate for a heat exchange.

7. The road finisher as claimed in claim 1, characterized in that, in order to clamp the heating element, at least one clamping plate is provided which is seated in a roof-shaped manner on the round-tube heating body.

8. The road finisher as claimed in claim 7, characterized in that the at least one clamping plate has keyhole-like cutouts for removably and lockably receiving the bolt ends with lock nuts.

9. The road finisher as claimed in claim 7, characterized in that the at least one clamping plate is designed in the form of a flat or pointed roof.

10. The road finisher as claimed in claim 7, characterized in that the at least one clamping plate is supported on the base plate.

11. The road finisher as claimed in claim 1, characterized in that the bolts are designed as screw bolts.

12. The road finisher as claimed in claim 1, characterized in that the bolts have a circumferential cutout adapted to the outer circumference of the round-tube heating body.

13. The road finisher as claimed in claim 1, characterized in that the bolts are made of metal.

14. The road finisher as claimed in claim 1, characterized in that the heating bar comprises a metal tube in which a heating conductor guided in an insulating material is arranged.

15. A road finisher having a screed extending transversely to the working direction of the finisher, said screed having a base plate which is heatable by an electrical heater clamped to the base plate, said heater comprising at least one bar-shaped heating element having a round-tube heating body which is fixably supported on individual bolts which can be fastened to the base plate and which form heat-conducting links, wherein the round-tube heating body is positioned on the base plate so as to be positioned on opposite sides of the bolts in such a manner that the heating bar contacts the base plate with minimal surface area contact and also contacts opposing sides of the individual bolts.

* * * * *